US010961071B2

(12) United States Patent
Talvitie et al.

(10) Patent No.: US 10,961,071 B2
(45) Date of Patent: Mar. 30, 2021

(54) WINDING MACHINE AND METHOD FOR CONTROLLING A SECOND NIP PRESSURE

(71) Applicant: ABB Schweiz AG, Baden (CH)

(72) Inventors: Tapio Talvitie, Espoo (FI); Pertti Vainio, Järvenpää (FI); Jukka Gruzdaitis, Vantaa (FI)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/603,109

(22) PCT Filed: Apr. 6, 2018

(86) PCT No.: PCT/EP2018/058933

§ 371 (c)(1),
(2) Date: Oct. 4, 2019

(87) PCT Pub. No.: WO2018/185325

PCT Pub. Date: Oct. 11, 2018

(65) Prior Publication Data

US 2020/0109020 A1 Apr. 9, 2020

(30) Foreign Application Priority Data

Apr. 6, 2017 (EP) ..... 17165237

(51) Int. Cl.
*B65H 18/26* (2006.01)
*B65H 18/20* (2006.01)

(52) U.S. Cl.
CPC ..... *B65H 18/26* (2013.01); *B65H 18/20* (2013.01); *B65H 2301/41376* (2013.01);
(Continued)

(58) Field of Classification Search
CPC .... B65H 18/20; B65H 18/26; B65H 2515/34; B65H 2511/14; B65H 2404/43; B65H 2408/232; B65H 2301/41376
See application file for complete search history.

(56) References Cited

U.S. PATENT DOCUMENTS 3,858,820 A * 1/1975 Crouse ..... B65H 18/20 242/413.5
3,937,410 A 2/1976 Justus
(Continued)

FOREIGN PATENT DOCUMENTS

JP S597650 A 1/1984

OTHER PUBLICATIONS

International Search Report and Written Opinion of the International Searching Authority Application No. PCT/EP2018/058933 Completed: Apr. 30, 2018; dated May 8, 2018 13 pages.

*Primary Examiner* — Sang K Kim
(74) *Attorney, Agent, or Firm* — Whitmyer IP Group LLC

(57) ABSTRACT

A winding machine for winding a finishing roll having a radius R of a sheet material on a core having a radius $r_c$ is provided. The winding machine includes: a support drum assembly arranged on a first side of the finishing roll and configured to support the finishing roll from the first side; a rider roll arranged on a second side of the finishing roll opposite to the first side and configured to apply a first nip pressure onto the finishing roll from the second side the finishing roll being supported by the support drum assembly; and a control unit configured to adaptively control the second nip pressure applied by the rider roll onto the finishing roll depending on an ascent rate of the rider roll.

15 Claims, 2 Drawing Sheets

(52) U.S. Cl.
CPC .... *B65H 2408/232* (2013.01); *B65H 2515/34* (2013.01); *B65H 2557/63* (2013.01)

(56) References Cited

U.S. PATENT DOCUMENTS 4,128,213 A * 12/1978 Komulainen ..... B65H 18/20
242/541.5
4,171,106 A * 10/1979 Crouse ..... B65H 18/20
242/534.2
4,811,915 A 3/1989 Smith
5,806,783 A * 9/1998 Turunen ..... B65H 18/20
242/530.1
6,089,496 A * 7/2000 Dorfel ..... B65H 18/00
242/413.1
6,584,366 B1 6/2003 Liepold et al.

* cited by examiner

WINDING MACHINE AND METHOD FOR CONTROLLING A SECOND NIP PRESSURE

FIELD

The present application relates to a winding machine and a method for controlling a second nip pressure, and specifically to a winding machine in which a second nip pressure is controlled depending on an ascent rate of a rider roll and a method for controlling a second nip pressure applied by a rider roll onto a finishing roll during winding of a sheet material on the finishing roll in dependence of an ascent rate of the rider roll.

BACKGROUND

Winding machines are machines for wrapping a sheet material, such as paper or textile, on a roll. In particular, in a winding machine, a sheet material is wrapped on a core to form finished rolls. The finished rolls are typically supported by a support assembly and pushed against the support assembly by a rider roll. To obtain a tightness profile of the finished roll the sheet material should be wounded on the finishing roll under similar conditions. During wrapping of the sheet material on the core the finishing roll increases in size. Accordingly, a nip pressure applied by the rider roll onto the finishing roll should be controlled to obtain a tightness profile and to attempt to keep the finishing roll inside the winding machine during all running, and do not to let the finishing roll be thrown out while turning.

The nip pressure should be controlled to be good enough in all situations. Conventional solutions work in certain (limited) circumstances, but are not optimized for all emerging cases. This can lead to poor tightness profile in finished rolls (further post processing and end-use problems, and broke rolls), failures in possible front splices, vibration, swinging and bouncing of the rolls, and even the finishing rolls can be thrown out in the middle of running, which in turn, when creating uncontrolled friction between rolls can cause fire, machinery breakdown and for operating personnel this is an obvious security risk. In winders this problem (risk) has aggravated when searching for capacity increase, by faster accelerations and higher running speeds.

Recently, the control of the nip pressure has been improved by adding a feed-forward (ff) component from an ascent rate of the rider roll. But the ff-term can never be sufficiently accurate, because the valve which is controlling the RR nip pressure is non-linear in many ways. Linearity depends on temperature and viscosity of hydraulic oil, and the change in differential pressure over the valve during reeling. Therefore, improving the pressure controller itself by finding and using optimal values for control of the nip pressure becomes an important role, in order to achieve the best available result.

At the beginning, when the finishing roll diameter is relatively small and the growth rate is high, a high gain is needed in the nip pressure controller, and towards the end of the winding, when the finishing roll diameter is large and has a small growth rate, then a less aggressive pressure controller is preferred. A too aggressive nip pressure controller is prone to cause vibrations, and on the other hand a too slow nip pressure controller fails to take the desired nip pressure, and thus deteriorates the tightness profile of finishing rolls.

In recent methods, PI (proportional-integral) force- or pressure-controller are used. PI values are optimized by changing gain and integration values with respect to the finishing roll diameter. This means that the PI controller is optimum only at certain web thickness and rate of diameter increase of the roll. As a result, optimizing the pressure controller PI values based only on the diameter does not bring the desired performance for all emerging situations. The problem with this can be seen, for example, in possible front splicing, where the rider roll instability can deteriorate the success of the joint. Similarly, a bad control of the nip pressure can expose the rolls, whereby the rolls can be thrown out in the middle of running, causing possible fire, machinery damage and is also a personal safety hazard.

SUMMARY

The above-mentioned shortcomings, disadvantages and problems are addressed herein which will be understood by reading and understanding the following specification. Specifically, the present disclosure outlines a winding machine having a controlled second nip pressure and a method for controlling a second nip pressure, which have increased reliability and can take account and/or overcome some or all of the above shortcomings.

According to an aspect, a winding machine for winding a finishing roll having a radius of a sheet material on a core having a radius is provided. The winding machine includes: a support drum assembly arranged on a first side of the finishing roll and configured to support the finishing roll from the first side; a rider roll arranged on a second side of the finishing roll opposite to the first side and configured to apply a second nip pressure onto the finishing roll from the second side while the finishing roll is supported by the support drum assembly; and a control unit configured to adaptively control the second nip pressure applied by the rider roll onto the finishing roll depending on an ascent rate of the rider roll.

According to embodiments, the control unit can be configured to calculate the ascent rate based on geometric properties of the winding machine and the sheet material, and a velocity of the sheet material, with which the sheet material can be particularly fed to the finishing roll. According to embodiments, the control unit can be configured to calculate the ascent rate based on the radius of the finishing roll, a velocity of the sheet material with which the sheet material is fed to the finishing roll, a thickness of the sheet material and a geometry of the winding machine.

According to embodiments, a first nip pressure is generated between the finishing roll and the support drum assembly by the second nip pressure and a, specifically increasing, weight of the finishing roll. Further, the control unit can be configured to adaptively control the second nip pressure to obtain a constant or slightly decreasing first nip pressure.

According to embodiments, the adaptivity of the control unit can be a function of the ascent rate of the rider roll.

According to embodiments, the winding machine can further include an actuator connected with the rider roll and configured to adjust the first nip pressure. Further, the actuator can be operably connected to the control unit.

According to embodiments, the support drum assembly can be configured to feed the sheet material to the finishing roll.

According to embodiments, the support drum assembly can include at least a first drum having a radius. According to embodiments, the support drum assembly can include a second drum having a radius and being arranged with a distance to the first drum. Specifically, the first drum and the second drum can have the same radius. Alternatively, the first drum and the second drum can have a different radius. For instance, the second drum can have a structure with two smaller rolls with a belt in between. When practicing embodiments, a longer and better nip contact with shipping rolls (less prone to slip) can be provided.

According to embodiments, the control unit can be configured to calculate the rider roll ascent rate based on the radius of the finishing roll, a velocity of the sheet material with which the sheet material is fed to the finishing roll, a thickness of the sheet material, a radius of the first drum and the second drum, and a spacing being half the distance between the first drum and the second drum.

According to embodiments, the rider roll accent rate can be determined by the following expression (1):

$$AR = \frac{d * v}{2 * \pi * R} * \left(1 + \frac{R + r}{\sqrt{(r + R)^2 - (r + s)^2}}\right), \quad (1)$$

where d is a thickness of the sheet material, v is a velocity of the sheet material with which the sheet material is fed to the finishing roll, r is the radius of the first drum and the second drum, and R is the radius of the finishing roll, and s is a spacing being half the distance between the first drum and the second drum.

According to an aspect, a method for controlling a first nip pressure applied by a rider roll onto a finishing roll during winding of a sheet material on the finishing roll is provided. The method includes: supporting the finishing roll by a support drum assembly arranged on a first side of the finishing roll and configured to support the finishing roll from the first side; and adaptively controlling the first nip pressure applied by a rider roll onto the finishing roll, wherein the rider roll is arranged on a second side of the finishing roll opposite to the first side, wherein the first nip pressure is adaptively controlled depending on an ascent rate of the rider roll.

According to embodiments, the ascent rate of the rider roll can be a function of growth rate of finishing roll relative to the support drum assembly due to the sheet material being wound on the finishing roll.

According to embodiments, the ascent rate of the rider roll can be calculated based on geometric properties of the winding machine and the sheet material, and a velocity of the sheet material, with which the sheet material can be particularly fed to the finishing roll. According to embodiments, the ascent rate of the rider roll can be calculated based on a radius of the finishing roll, a velocity of the sheet material with which the sheet material is fed to the finishing roll, a thickness of the sheet material and a geometry of the winding machine.

According to embodiments, the second nip pressure applied from the second side can be controlled to generate a constant or slightly decreasing first nip pressure between the finishing roll and the support drum assembly.

According to embodiments, the sheet material can be fed to the finishing roll by the support drum assembly.

Embodiments are also directed at apparatuses for carrying out the disclosed methods and include apparatus parts for performing each described method aspect. These method aspects may be performed by way of hardware components, a computer programmed by appropriate software, by any combination of the two or in any other manner. Furthermore, embodiments according to the disclosure are also directed at methods for operating the described apparatus. The methods for operating the described apparatus include method aspects for carrying out functions of the apparatus.

BRIEF DESCRIPTION OF THE DRAWINGS

So that the manner in which the above recited features of the present disclosure can be understood in detail, a more particular description of the disclosure, briefly summarized above, may be had by reference to embodiments. The accompanying drawings relate to embodiments of the disclosure and are described in the following.

DETAILED DESCRIPTION OF EMBODIMENTS

Reference will now be made in detail to the various embodiments of the disclosure, one or more examples of which are illustrated in the figures. Within the following description of the drawings, the same reference numbers refer to same components. Typically, only the differences with respect to individual embodiments are described. Each example is provided by way of explanation of the disclosure and is not meant as a limitation of the disclosure. Further, features illustrated or described as part of one embodiment can be used on or in conjunction with other embodiments to yield yet a further embodiment. It is intended that the description includes such modifications and variations. Unless otherwise stated herein, a percentage for a specific element in a chemical composition shall refer to a mass percentage of that element in the chemical composition.

Figure 1:
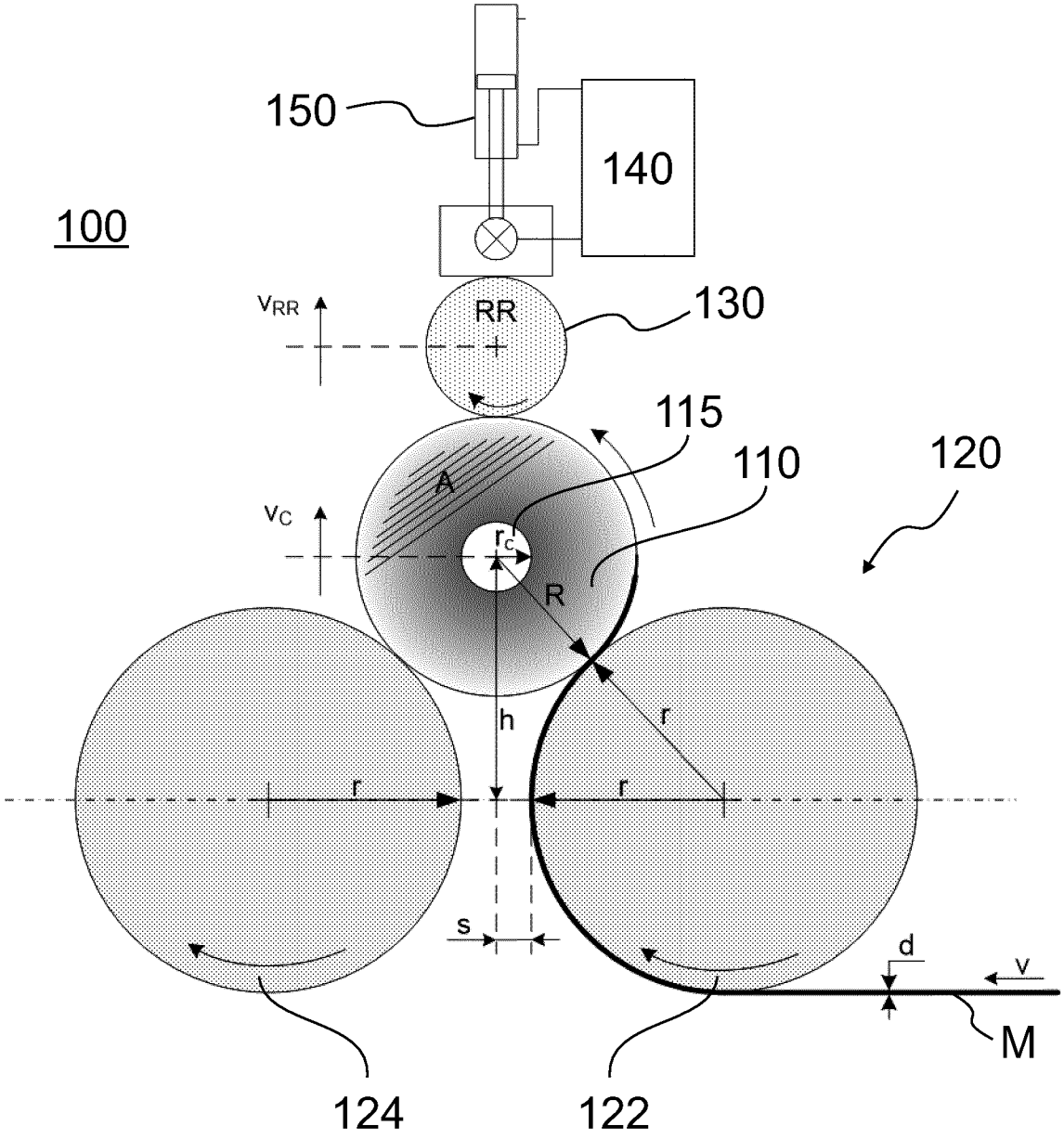
FIG. 1 shows a schematic view of a winding machine according to embodiments.

FIG. 1 shows a winding machine 100. The winding machine 100 can wind a finished roll 110 of sheet material M. In particular, the winding machine 100 can wrap or wind sheet material M on a core 115. For instance, the core 115 can be a hollow pipe or tube, which may be made, e.g., of cardboard. The core 115 can have a radius $r_c$. The finishing roll 110 can have a radius R. The radius R can be the sum of the radius $r_c$ of the core 115 plus a thickness of a wound sheet material A. The wound sheet material A can be the sheet material M that is wound on the core 115 to form the finishing roll 110. Specifically, the finished roll 110 includes core 115 and/or can be removed from the winding machine 110 together with the core 115.

The finishing roll 110 and/or the core 115 can define a first side and a second side opposite to the first side. As the finishing roll 110 and/or the core 115 can rotate within the winding machine 100, the first side and the second side may not be understood as being fixed with respect to a certain circumferential portion of the finishing roll 110 and/or the core 115, and hence rotate together with the finishing roll 110 and/or the core 115. Rather, the first side and the second side can be understood as relating to the first side and the second side of the finishing roll 110 and/or the core 115 with respect to the winding machine 100. Accordingly, the first side can be understood as a portion of the winding machine that is on one side of the winding machine with respect to a center of the finishing roll 110 and/or the core 115. Whereas the second side can be understood as a portion of the winding machine 100 that is on the other side of the winding machine 100 with respect to the center of the finishing roll 110 and/or the core 115.

A support drum assembly 120 can be arranged on the first side. The support drum assembly 120 can be configured to support the finishing roll 110 from the first side. A rider roll 130 can be arranged on the second side. The rider roll 130 can be configured to apply a second nip pressure onto the finishing roll 110 from the second side. Specifically, the finishing roll 110 can be supported by the support drum assembly 120 while the rider roll 130 applies the second nip pressure onto the finishing roll 110.

That is, the rider roll 130 can press the finishing roll 110 from the second side. According to embodiments, a physical weight of the rider roll 130 can be so high that an actuator 150 is provided, which lifts the rider roll 130 or reliefs weight of rider roll 130. As a result the nip pressure below rider roll 130 is less than the one that would be caused by the weight of rider roll 130. Anyway, the resulting pressure can be understood as nip pressure, regardless if the weight of the rider roll 130 is increased or relieved. According to embodiments described herein, the actuator 150 can be connected to the rider roll 130 and/or configured to adjust the nip pressure. Further, the actuator 150 can be operably connected to the control unit 140.

Further, a control unit 140 can be provided. The control unit 140 can be configured to adaptively control the second nip pressure applied by the rider roll onto the finishing roll 110 depending on an ascent rate AR of the Rider roll.

As outlined above, recent methods use a dependence on a diameter of the finishing roll which however does not provide sufficiently good results in all situations. According to embodiments described herein, the control of the nip pressure can be based on the ascent rate AR of the rider roll 100. The ascent rate AR of the rider roll 130 can be a function of a growth rate of the radius R of the finishing roll 110. Further, the machine geometry can define the rider roll ascent rate AR. From a mathematical point of view, the rider roll ascent rate AR can be considered as the most correct way to determine the optimal control of the second pressure. In practice, adaptive control can be provided that is capable to provide optimal results in all different situations.

According to embodiments described herein, the control unit 140 can be configured to calculate the rider roll ascent rate AR based on geometric properties of the winding machine 100 and the sheet material M, and a velocity v of the sheet material, with which the sheet material M can be particularly fed to the finishing roll 110. According to embodiments, the control unit 140 can be configured to calculate the rider roll ascent rate AR based on the radius R of the finishing roll 110, a velocity v of the sheet material M with which the sheet material M is fed to the finishing roll 110, a thickness d of the sheet material 110 and a geometry of the winding machine 100.

Specifically, the first nip pressure can be controlled by means of the second nip pressure. When the rider roll nip pressure control is on, on the second side of the finishing roll, the control can be best optimized to fit with various process requirements when relying on the ascent rate of rider roll, rather than only on web speed or roll diameter. When practicing embodiments, the second nip pressure can be controlled in such a manner that the first nip pressure stays the same. Specifically, the difference to recent winding machines may be how stable the control of the second nip pressure can be realized in abnormal, unexpected situations, like in web brakes and high machine and roll vibrations. In practice, worst case scenarios in which the rider roll instability can evolve to huge material damages and personal hazards, if stability is lost, can be avoided.

According to embodiments described herein, the control unit 140 can control a flow control valve, as it is commonly used in winding machines, to control the first nip pressure.

When practicing embodiments, the finishing rolls can be wound better and a more uniform tightness profile can be obtained. Further, there is a smaller probability to have finishing roll throw-outs at running speed, which events may lead to further machinery damage and production losses. Furthermore, in roll throw-outs there is always a security risk too, when breaking parts may fly to the working areas. Moreover, an increased reeling capacity can be obtained by allowing higher running speeds and faster accelerations without compromising the functional or machine safety.

According to embodiments described herein, the control unit 140 can use control values to adaptively control the second nip pressure. For instance, the control unit can include an adaptive control unit for controlling the second nip pressure. The adaptive control unit can be, e.g., a PI (proportional-integral) controller, which can use PI values to adaptively control the second nip pressure.

According to embodiments described herein, a first nip pressure can be generated between the finishing roll 110 and the support drum assembly 120 by the second nip pressure and a, specifically increasing, weight of the finishing roll 110. The control unit 140 can be configured to adaptively control the second nip pressure to obtain a constant or slightly decreasing first nip pressure.

Specifically, the rider roll 130 may press the finishing roll 100 from the first side. An aim of embodiments described herein may be to obtain an approximately constant or slightly decreasing first nip pressure between the finishing roll 110 and the support drum assembly 120. This first nip pressure can be generated by the support of the finishing roll 110 by the support drum assembly 120. As the finishing roll 110 is growing up, the weight of the finishing roll 100 may increase the first nip pressure. Accordingly, the second nip pressure may be decreased to obtain an approximately constant or slightly decreasing first nip pressure.

In order to ensure proper nip pressure, not only the reference may be taken into account, but also an active control of the second nip pressure. It may be particularly beneficial in practice when the control is adaptive. Normally, the use of fixed Gain and Integral time values in the control unit 140 are not sufficient to overcome hazardous situations (like vibrations and web breaks). By using the adaptive control described herein, the behaviour of the control unit (the "sensitivity" or "responsiveness") can be adapted in operation.

In particular, an optimal adaptivity in the control of the second nip pressure (e.g. in P and I-values) can be achieved as a function of the ascent rate AR of the rider roll 130, particularly when the rider roll 130 is moved upwards (along an increase of the radius R of the finishing roll 110) and/or in changing the relief force (along an increase of the radius R of the finishing roll 110). According to embodiments described herein, the adaptivity of the control unit 140 can be a function of the ascent rate AR of the rider roll 130.

According to embodiments described herein, the support drum assembly 120 can be configured to feed the sheet material M to the finishing roll 110. In particular, the support drum assembly 120 can be configured to feed the sheet material M to the finishing roll 110 with a velocity v. Specifically, it can be a motor control unit that calculates the rider roll ascent rate AR. The ascent rate AR can be transferred to the adaptive control unit for adaptive control of the second nip pressure. That is, the control unit 140 can include several sub-units, which may be configured for different purposes and cooperate with each other.

According to embodiments described herein, the support drum assembly 120 can includes at least a first drum 122 having a radius r. The first drum 122 can be configured to feed the sheet material M to the finishing roll 110. Specifically, the first nip pressure can be applied between the finishing roll 110 and the first drum 122.

According to embodiments described herein, the support drum assembly 120 can include a second drum 124 having a radius r and being arranged with a distance 2*s* to the first drum. Specifically, the first drum 122 and the second drum 124 can have the same radius r. Alternatively, the first drum 122 and the second drum 124 can have different radius. For instance, the first drum 122 can have a radius being smaller than the radius of the second drum 124. Alternatively, the first drum 122 can have a radius being larger than the radius of the second drum 124. In case the drum assembly 120 includes the first drum 122 and the second drum 124 a first nip pressure can be applied between the finishing 110 and the first drum 122 as well as between the finishing roll 110 and the second drum 124.

According to embodiments described herein, the control unit 140 can be configured to calculate the rider roll ascent rate AR based on the radius R of the finishing roll 110, the velocity v of the sheet material M with which the sheet material M is fed to the finishing roll 110, a thickness d of the sheet material M, the radius r of the first drum 122 and the second drum 124, and a spacing s being half the distance 2*s* between the first drum 122 and the second drum 124.

According to embodiments described herein, the accent rate AR of rider roll can be determined by the following expression (1):

$$AR = \frac{d*v}{2*\pi*R}*\left(1+\frac{R+r}{\sqrt{(r+R)^2-(r+s)^2}}\right), \quad (1)$$

where d is the thickness of the sheet material M, v is the velocity of the sheet material M with which the sheet material M is fed to the finishing roll 110, r is the radius of the first drum 122 and the second drum 124, and R is the radius of the finishing roll 110, and s is a spacing being half the distance 2*s* between the first drum 122 and the second drum 124.

Specifically, the ascent rate can be determined as follows:

1. The radius R of the finishing roll 110 as a function of a web length 1 in the finishing roll 110.
   Area A on roll side:

$$\begin{cases} A = \pi*R^2-\pi*r_C^2 \\ A = l*d \end{cases} \quad (i)$$

$$R = \sqrt{l*\frac{d}{\pi}+r_C^2}$$

where l is the web length in the finishing roll 110.

2. Rate of change in the radius R'(t) of the finishing roll 110 as a function of web speed (v) and the radius (R) of the finishing roll 110:
   Both length (l) and radius (R) are functions of time:

$$l(t) = \frac{\pi}{d}*R(t)^2-\frac{\pi}{d}*r_C^2, \quad (ii)$$

to be differentiated with respect to $(t)$ $$l'(t) = 2*\frac{\pi}{d}*R(t)*R'(t), \text{ hereinafter } R(t) = R$$

$l'(t)$ = change in length = web speed $v(t) = v$

-continued $$l(t) = v(t)*t, \rightarrow l'(t) = v(t) = v$$

$R'(t)$ = rate of change in roll radius $$R'(t) = \frac{d*v}{2*\pi*R}$$

$$\text{E.g. } R'(t) = \frac{(0.0001 \text{ m}*40 \text{ m/s})}{(2*\pi*0.5 \text{ m})} = 1.27 \text{ mm/s}$$

3. Trigonometry allows us to solve a height (h) of the core 115:

$$h^2+(r+s)^2=(r+R)^2$$

$$h=\sqrt{(r+R)^2-(r+s)^2} \quad (iii)$$

4. The ascent rate of the core h' (R) as a function of a growth of the radius of the finishing roll 110.
   The core height (h) is a function of roll radius (R). Taking the first derivative of the first one with respect to (R) (implicit function)

$$h(R)^2=(r+R)^2-(r+s)^2$$

$$h(R)^2=R^2+2rR-2rs-s^2, \text{ first derivative}$$

$$2*h(R)*h'(R)=2R+2r, \text{ hereinafter } h(R)=h$$

$$h'(R) = \frac{R+r}{h} = \frac{R+r}{\sqrt{(r+R)^2-(r+s)^2}} \quad (iv)$$

h'(R) is the ascent rate of the core 115 the in proportion to the growth of the radius of the finishing roll 110.

If h'(R)=1, then the core 115 will rise at the same rate as R increases. In practice, the core will be faster, because due to geometry the roll "rises", i.e. h'(R)>1.

h'(R) is a pure number.

5. The ascent rate ($v_c$) of the core 115 is:

$$v_c=R'(t)*h'(R)$$

6. The ascent rate ($v_{RR}$) of the rider roll 130 is:

$$v_{RR} = v_C+R'(t) = R'(t)*h'(R)+R'(t) \quad (v)$$

$$v_{RR} = R'(t)*(1+h'(R))$$

$$v_{RR} = \frac{d*v}{2*\pi*R}*\left(1+\frac{R+r}{\sqrt{(r+R)^2-(r+s)^2}}\right)$$

The above determination of the rider roll ascent rate may hold true for the exemplary configuration of the winding machine 100 depicted in FIG. 1. For other configuration of the winding machine 100, the ascent rate AR can be determined and in an analogous manner taking the considerations described herein into account. For instance, the present disclosure can also be applied to the structure in which the second drum is replaced with two smaller rolls with a belt in between.

Figure 2:
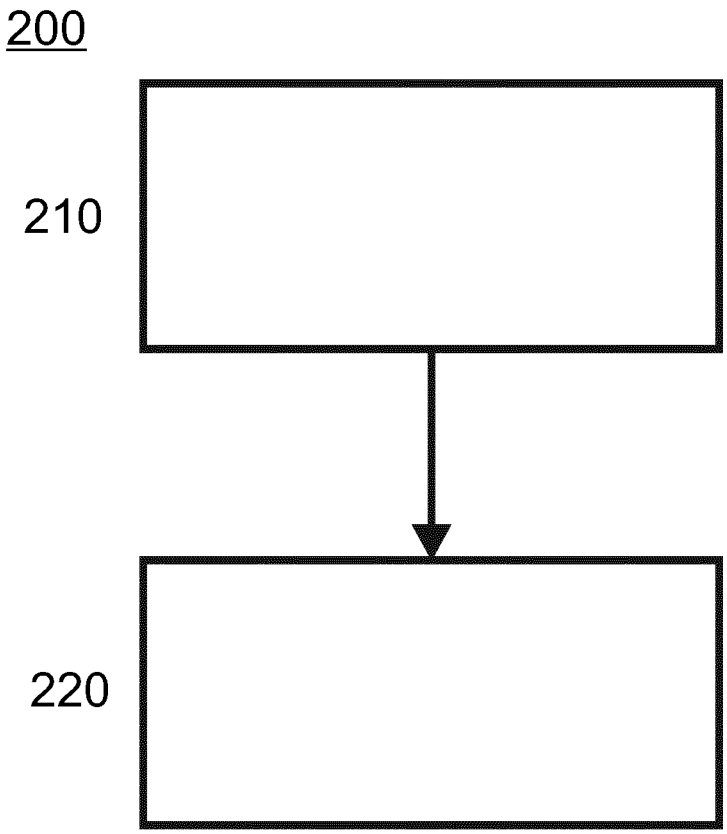
FIG. 2 shows a flow diagram illustrating a method for controlling a first nip pressure according to embodiments.

FIG. 2 shows a flow diagram illustrating a method 200 for controlling a second nip pressure applied by a rider roll 130 onto a finishing roll 110 during winding of a sheet material M on the finishing roll 110. In block 210, the finishing roll 110 is supported by a support drum assembly 120 arranged on a first side of the finishing roll 110 and configured to support the finishing roll 110 from the first side. In block 220, the second nip pressure applied by a rider roll 130 onto the finishing roll 110 is adaptively controlled, wherein the rider roll 130 is arranged on a second side of the finishing roll 110 opposite to the first side. Further, the second nip pressure is adaptively controlled depending on an ascent rate AR of the rider roll 110.

According to embodiments described herein, the ascent rate AR of the rider roll 130 can be a function of growth rate of the finishing roll 110 relative to the support drum assembly 120 due to the sheet material M being wound on the finishing roll 110.

According to embodiments described herein, the method includes, a further block, controlling the second nip pressure applied from the second side to generate a constant or slightly decreasing first nip pressure between the finishing roll 110 and the support drum assembly 120.

According to embodiments of the method includes, in a yet further block, feeding the sheet material M to the finishing roll 110 by the support drum assembly 120.

According to embodiments described herein, the ascent rate AR is calculated based on a radius R of the finishing roll 110, a velocity v of the sheet material M with which the sheet material M is fed to the finishing roll 110, a thickness d of the sheet material M and a geometry of the winding machine 100.

While the foregoing is directed to embodiments of the disclosure, other and further embodiments of the disclosure may be devised without departing from the basic scope thereof, and the scope thereof is determined by the claims that follow.

The invention claimed is:

1. A winding machine for winding a finishing roll having a radius R of a sheet material on a core having a radius re, comprising:

a support drum assembly arranged on a first side of the finishing roll and configured to support the finishing roll from the first side;

a rider roll arranged on a second side of the finishing roll opposite to the first side and configured to provide a second nip pressure onto the finishing roll from the second side while the finishing roll is supported by the support drum assembly; and an adaptive control unit configured to adaptively control the second nip pressure applied by the rider roll onto the finishing roll depending on an ascent rate of the rider roll, which is proportionate to a derivative of the radius of the finishing roll.

2. The winding machine according to claim 1, wherein the control unit is configured to calculate the rider roll ascent rate based on the radius of the finishing roll, a velocity of the sheet material with which the sheet material is fed to the finishing roll, a thickness of the sheet material and a geometry of the winding machine.

3. The winding machine according to claim 1, wherein a first nip pressure is generated between the finishing roll and the support drum assembly by the first nip pressure and a weight of the finishing roll, and wherein the control unit is configured to adaptively control the first nip pressure to obtain a constant or slightly decreasing first nip pressure.

4. The winding machine according to claim 1, wherein the adaptivity of the control unit is a function of the ascent rate of the rider roll.

5. The winding machine according to claim 1, further comprising an actuator connected to the rider roll and configured to adjust the first nip pressure, wherein the actuator is operably connected to the control unit.

6. The winding machine according to claim 1, wherein the support drum assembly is configured to feed the sheet material to the finishing roll.

7. The winding machine according to claim 1, wherein the support drum assembly includes at least a first drum having a radius.

8. The winding machine according to claim 7, wherein the support drum assembly includes a second drum having a radius and being arranged with a distance to the first drum.

9. The winding machine according to claim 8, wherein the control unit is configured to calculate the ascent rate of the rider roll based on the radius of the finishing roll, a velocity of the sheet material with which the sheet material is fed to the finishing roll, a thickness of the sheet material, a radius of the first drum and the second drum, and a spacing being half the distance between the first drum and the second drum.

10. The winding machine according to claim 8, wherein the accent rate is determined by the following expression (1):

$$AR = \frac{d * v}{2 * \pi * R} * \left(1 + \frac{R + r}{\sqrt{(r + R)^2 - (r + s)^2}}\right), \quad (1)$$

where d is a thickness of the sheet material, v is a velocity of the sheet material with which the sheet material is fed to the finishing roll, r is the radius of the first drum and the second drum, and R is the radius of the finishing roll, and s is a spacing being half the distance between the first drum and the second drum.

11. A method for controlling a second nip pressure applied by a rider roll onto a finishing roll during winding of a sheet material on the finishing roll, comprising:

supporting the finishing roll by a support drum assembly arranged on a first side of the finishing roll and configured to support the finishing roll from the first side; and adaptively controlling, via an adaptive control unit, the second nip pressure applied by a rider roll onto the finishing roll, wherein the rider roll is arranged on a second side of the finishing roll opposite to the first side, wherein the second nip pressure is adaptively controlled depending on an ascent rate of the rider roll, which is proportionate to a derivative of a radius of the finishing roll.

12. The method according to claim 11, wherein the ascent rate of the rider roll is a function of growth rate of the finishing roll relative to the support drum assembly due to the sheet material being wound on the finishing roll.

13. The method according to claim 11, wherein the ascent rate of the rider roll is calculated based on the radius of the finishing roll, a velocity of the sheet material with which the sheet material is fed to the finishing roll, a thickness of the sheet material and a geometry of the winding machine.

14. The method according to claim 11, further comprising:

controlling the second nip pressure applied from the second side to generate a constant or slightly decreasing first nip pressure between the finishing roll and the support drum assembly.

15. The method according to claim 11, further comprising:

feeding the sheet material to the finishing roll by the support drum assembly.

* * * * *